United States Patent [19]

Orr

[11] Patent Number: 4,843,657

[45] Date of Patent: Jul. 4, 1989

[54] ANTI-FLOOD TOILET TANK FILL VALVE

[76] Inventor: James W. Orr, 471 Lowell Dr., Santa Clara, Calif. 95051

[21] Appl. No.: 97,669

[22] Filed: Sep. 17, 1987

[51] Int. Cl.[4] ..... E03D 5/00

[52] U.S. Cl. ..... 4/405; 4/415; 137/410

[58] Field of Search ..... 4/415, 412, 413, 249, 4/353, 405, 366, 333, 300, 324, 325, 427; 137/432, 312, 420, 421, 444, 443, 445, 410

[56] References Cited

U.S. PATENT DOCUMENTS 3,254,665 6/1966 Bachli et al. ..... 137/432 X 4,351,071 9/1982 Clar ..... 4/366 X

*Primary Examiner*—A. D. Pellinen

*Assistant Examiner*—Morris Ginsburg

*Attorney, Agent, or Firm*—Flehr, Hohbach, Test

[57] ABSTRACT

A catch mechanism is provided for use in a toilet tank flushing arrangement that includes a tank for storing water, a manually operated flush lever for causing the water to drain from the tank to flush the toilet, and a float means for detecting the presence of a low tank water level and causing the tank to refill when the low tank water level is detected. The catch mechanism is adapted to engage the float means to prevent it from causing the tank to refill, unless the flush lever has been operated.

10 Claims, 2 Drawing Sheets

ANTI-FLOOD TOILET TANK FILL VALVE

BACKGROUND OF THE INVENTION

The present invention relates generally to attachments for toilet tanks. More particularly, to prevent flooding in the event of a cracked toilet tank, a catch arrangement is disclosed that prevents the tank from refilling unless the flush lever has been activated.

Modern toilets in both home and commercial environments frequently incorporate a design that includes a tank that stores water in anticipation of the next flush. The toilet tanks are typically made from a relatively brittle ceramic material. Thus, while the standard toilet tank construction is both inexpensive and efficient, they have the drawback of being susceptible to cracking. If a crack develops below the water line and penetrates the tank wall, water will leak from the tank and flood the surrounding rooms. Most toilet tanks presently in existence includes a float arrangement that causes the tank to begin refilling any time the water level falls below a set level. Thus, if the crack extends below the set refill level, the tank will empty and attempt to refill itself, thereby causing continued leaking. When such leakage goes undetected for an extended period of time, as when the crack develops or enlarges when a home owner is away, extensive flooding can occur. Therefore, there is a need for a device which prevents extensive flooding from a cracked toilet tank.

Another common problem experienced by toilet tanks is the deterioration of the rubber stopper and/or the flush valve seat which seals the drain leading from the tank to the toilet bowl. When either happens water will leak from the tank into the bowl. Such leakage reduces the water level in the tank causing the fill valve float to drop enough to allow water to flow into the tank in an attempt to restore the water level to the set refill level. This results in water continually running sometimes quietly enough to be undetected. Therefore, there is a need for a mechanism that will alert the user to the presence of a leaking flush valve as well.

SUMMARY OF THE INVENTION

Accordingly, to prevent flooding, it is a primary objective of the present invention to provide a means of preventing the tank fill valve from opening unless a user flushes the toilet.

Another objective of the present invention is to provide an attachment that may be used to retrofit existing toilet tanks.

Another objective of the present invention is to save water by alerting the user to a leaking flush valve.

To achieve the foregoing and other objectives and in accordance with the purpose of the present invention, a catch arrangement is provided for use in a toilet tank flushing arrangement that includes a tank for storing water, a manually operated flush lever for causing the water to drain from the tank to flush a toilet, and a float means for detecting the presence of a low tank water level and causing the tank to refill when the low tank water level is detected. The catch arrangement being adapted to prevent the float means from causing the tank to refill unless the flush lever has been activated.

The catch arrangement preferably includes a catch arm that is connected to the flush lever and adapted to engage the float means for preventing the float means from opening a tank fill valve that allows water into the tank when open.

BRIEF DESCRIPTION OF THE DRAWINGS

The features of the present invention, which are believed to be novel, are set forth with particularity in the appended claims. The invention, together with further objectives and advantages thereof, may be understood by reference to the following description when taken in conjunction with the accompanying drawings in which:

DETAILED DESCRIPTION OF A PREFERRED EMBODIMENT

Figure 1:
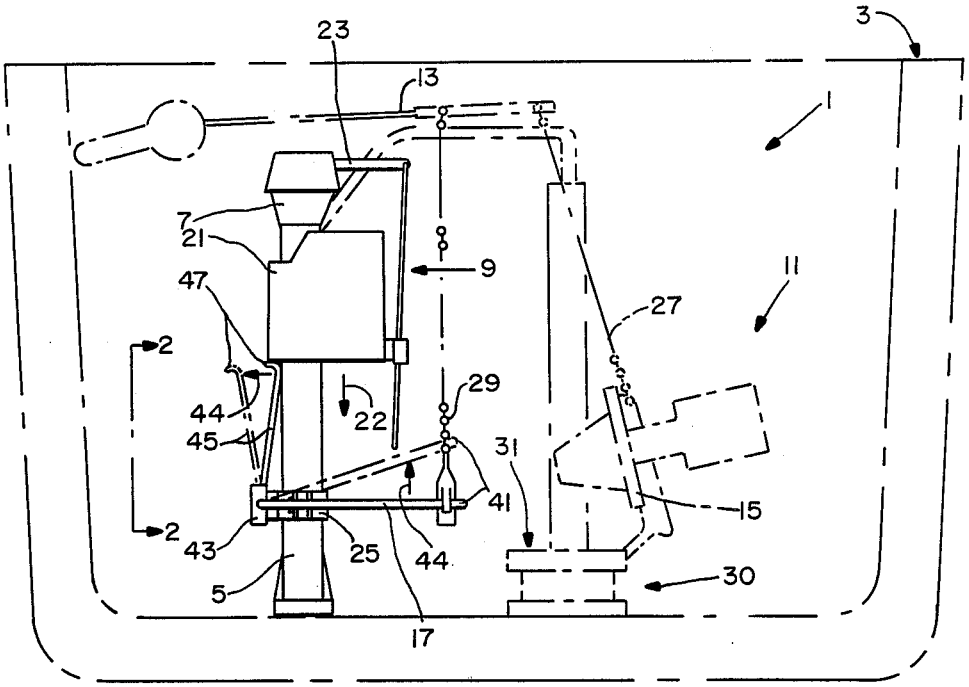
FIG. 1 is a partially broken away front view of a toilet tank that incorporates a catch in accordance with the present invention.
Figure 2:
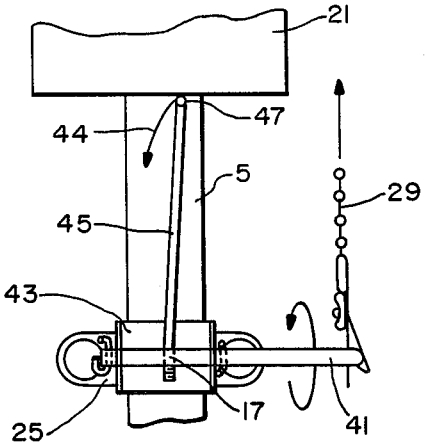
FIG. 2 is a side view of the float arrangement shown in FIG. 1 taken along section line 2—2, as seen in FIG. 3 and emphasizing the catch lever position.

As illustrated in the drawings, the present invention relates to a catch mechanism adapted for preventing extensive flooding from a cracked toilet tank. A typical toilet tank flushing arrangement 1 is disposed within a toilet tank 3 that stores water. The toilet tank flushing arrangement 1 includes a post 5 which carries a tank fill valve 7 that controls the influx of water into the tank. A float means 9 and a flush means 11 are provided to control the amount of water within the tank 3. The float means 9 is carried by post 5 for opening and closing tank fill valve 7. Specifically, float means 9 is adapted to open tank fill valve 7 when water level within the tank 3 falls below a designated fill level. Similarly, the float means 9 closes tank fill valve 7 when the water reaches a designated full level.

Flush means 11 is adapted for discharging water from the tank to flush the toilet. Typically flush valve 11 includes a manually operable flush lever 13 that the user activates to flush the toilet. The lever 13 is typically connected to a stopper 15 that plugs the bottom of the tank 3. When flush lever 13 is activated, stopper 15 is raised allowing the water to flow out of tank 3. After the water is discharged from the tank 3, the stopper 15 plugs the tank 3 to allow filling. The improvement of the present invention includes a catch mechanism 17 that is connected to the flush lever 13 and is adapted to prevent the float means 9 from opening tank fill valve 7 unless the flush lever 13 has been activated.

As will be appreciated by those skilled in the art, there are a wide range of different arrangements of flush means and float means that are currently in use. Thus, the present invention will be discussed as it may be applied to work simply and effectively on a pair of existing toilet flushing arrangements. Throughout the drawings there are a number of components that perform substantially the same function in different embodiments. To emphasize the similarities, like components will be designated by like numbers.

Referring first to FIG. 1, an embodiment of the invention adapted to work with a FLUIDMASTER 400A tank type toilet tank repair valve available from Fluidmaster, Inc. of Anaheim, California will be described. A post 5 disposed within tank 3 includes an internally mounted tank fill valve 7. Float means 9 includes a buoyant float 21 that is slideably coupled to the post 5 and is adapted to move vertically within the tank 3 dependent upon the fluid level within the tank. Arrows 22 mark the movement of float 21. A float lever 23 attached to the float 21 opens and closes valve 7 dependent upon the vertical position of float 21.

Flush lever 13 is connected by linkage 27 to flush valve 30. The flush valve 30 has a rubber stopper 15 which is either pivoted or raised off the flush valve seat 31 to allow water to drain from the tank 3 into the bowl. Linkage 27 which preferably takes the form of an adjustable length chain, lifts stopper 15 off of flush valve seat 31 when flush lever 13 is activated in order to empty the tank. Stopper 15 is balanced such that when tank 3 is substantially empty, it will reseat on flush valve seat 31 thereby sealing the flush valve. In the event of a leaky flush valve 30, the catch mechanism 17 will prevent tank 3 from refilling, thereby alerting the user to the problem.

Catch mechanism 17 includes counterweight arm 41, bracket 43 and catch arm 45, and is coupled to post 5 by clamp 25. Counterweight arm 41 is substantially L-shaped and is rotatably mounted to bracket 43 which in turn is connected to clamp 25. Catch arm 45 has a rounded upper end 47 and its lower end is attached to counterweight arm 41 such that catch arm 45 is attached to counterweight arm 41 so that when counterweight arm 41 is substantially horizontal, catch arm 45 will abut against post 5. Clamp 25 is positioned on post 5 such that when tank 3 is filled to its desired level, the rounded upper end 47 of catch arm 45 is positioned just underneath float 21. Since counterweight arm 41 causes catch arm 45 to rest against post 5 under normal conditions, the rounded upper end 47 of catch arm 45 will position itself under float 21 under normal conditions as is shown in solid lines in FIG. 1. Thus, if the water should leak from tank 3, float 21 will rest upon rounded upper end 47 of catch arm 45 thereby preventing it from moving downward along post 5. Since float 21 is not allowed to move downward along post 5, float lever 23 will not be activated to open tank fill valve 7. Therefore, if a crack develops which allows water in the tank 3 to leak from the tank, tank fill valve 7 will be prevented from opening to allow more water into the tank, thereby inherently limiting the size of the leak.

The flush chain 29 connects the flush lever 13 to the free end of counterweight arm 41. The flush chain 29 is readily adjustable in length and positioned such that when flush lever 13 is activated, counterweight arm 41 is rotated to a position as shown in broken lines in FIG. 1. This causes catch arm 45, which is fixably connected to counterweight arm 41, to swing clear of float 21, thereby allowing the float 21 to descend as the water level recedes within tank 3. The movement of counterweight arm 41 and catch arm 45 is marked by arrows 44. Such movement allows the float means 9 to operate in its intended fashion thereby causing the tank to refill. After flush lever 13 is released, tension is removed from flush chain 29 and the weight of counterweight arm 41 causes catch arm 45 to rest against the side of float 21 which has descended due to the emptying of tank 3. Once tank 3 has been refilled, float 21 rises above catch arm 45 thereby allowing counterweight arm 41 to rotate catch arm 45 until it rests against post 5 as is shown in solid lines in FIG. 1.

Figure 3:
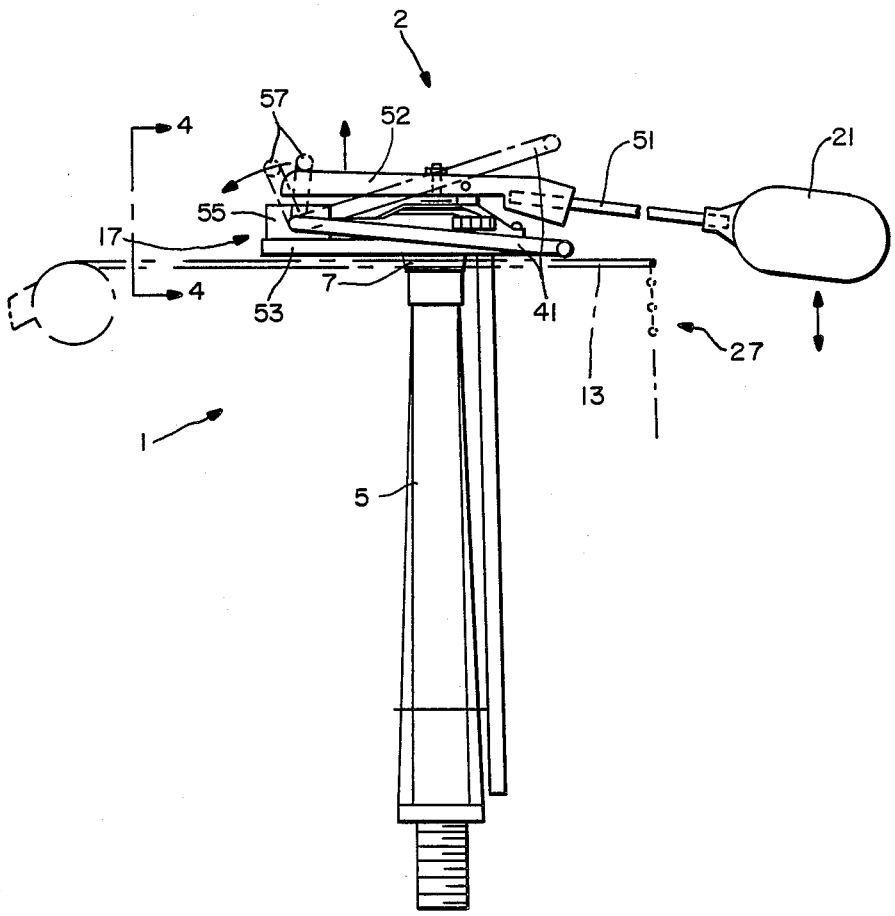
FIG. 3 is a front elevational view of an alternative embodiment of the present invention applied to a fill valve arrangement having a float at the end of a pivot arm.
Figure 4:
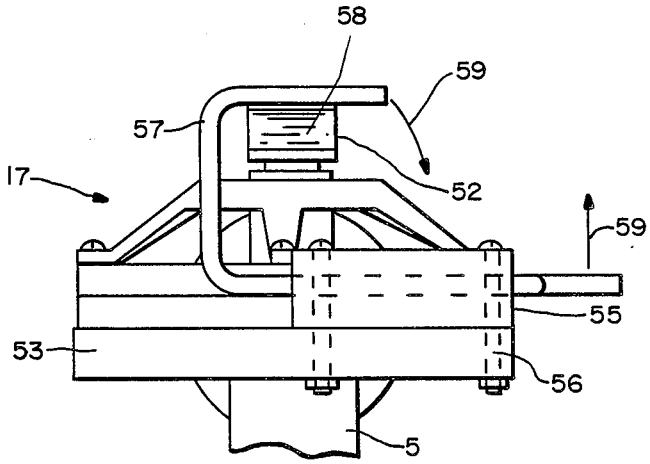
FIG. 4 is an enlarged side view of the catch lever in the embodiment shown in FIG. 3.

FIGS. 3 and 4 show an alternative embodiment of the present invention which is adapted to work with a standard tank fill valve having a float arm 2. In this embodiment, post 5 is disposed within tank 3 and includes an internally mounted tank fill valve 7. The float means includes a buoyant float 21 disposed at the free end of float arm 51 and a hinged member 52 that forms an extension of arm 51. Hinged member 52 is pivotably coupled to post 5 and directly attached to tank fill valve 7 such that its pivotal movement opens and closes the valve. Float 21 is adapted to move vertically with the changing water level and while float arm 51 and hinged member 52 act much like float lever 23 as previously described in order to open and close tank fill valve 7 dependent upon the vertical position of float 21. The flush valve arrangement in this embodiment may be identical to the flush valve mechanism previously described with respect to FIG. 1.

Catch mechanism 17 includes a mounting plate 53 to which bracket 55 is secured by bolts 56. Counterweight arm 41 is rotatably mounted to bracket 55. A U-shaped catch arm 57 forms an extension of counterweight arm 41 which is adapted to engage the end of hinged member 52 opposite float 21. The counterweight arm 41 is adapted to ride on flush level 13. Thus, when flush lever 13 is activated, the counterweight arm 41 and catch arm 57 will rotate from the position shown in solid lines in FIG. 3 to the position shown in broken lines, thereby releasing hinged member 52. It will be appreciated that when hinged member 52 is engaged by catch arm 57, float arm 51 and thus float 21 are prevented from rotating downward. Thus, in the event that tank 3 cracks sufficiently to leak, float 21 will not be free to descend vertically and tank fill valve 7 will not be opened. However, activating flush lever 13 causes the counterweight arm 41 to rotate as marked by arrows 59, thereby causing catch arm 57 to disengage hinged member 52 which allows float 21 to travel vertically with the water level within tank 3 to cause normal operation of the toilet and refilling of tank 3.

When tank 3 has been refilled, the weight of counterweight arm 41 causes catch arm 57 to reengage hinged member 52. The leading edge 58 of hinged member 52 may be rounded to facilitate catch arm 57 smoothly passing over the leading edge 58 to engage or disengage the hinged member 52.

Although only two embodiments of the present invention have been described in detail, it should be understood that the present invention may be embodied in many other specific forms without departing from the spirit or scope of the invention. Particularly, it should be understood that the present invention may be adapted to work with virtually any mechanical flushing arrangement. The actual shape of the catch mechanism may be widely varied within the scope of the invention in order to prevent the float arrangement from opening the toilet tank fill valve unless the flush lever has been activated. Therefore, the present examples and embodiments are to be considered as illustrative and not restrictive, and the invention is not to be limited to the details given herein, but may be modified within the scope of the appended claims.

I claim:

1. In a toilet flushing arrangement including a tank for storing water, a manually operated flush lever for causing the water to drain from the tank to flush the toilet, and float means for detecting the presence of a low tank water level, and causing the tank to refill, the improvement comprising means for preventing the float means from causing the tank to refill unless said flush lever has been activated, said refill preventing means serving to prevent replenishment of water leaked from the tank, to minimize flooding in the event of a cracked tank.

2. A device for preventing extensive flooding from a leaking toilet tank comprising:

a post disposed substantially vertically within the toilet tank;

a tank fill valve for controlling the influx of fluid into the tank;

a float means carried by the post for monitoring the height of the fluid within the tank, the float means for opening the tank fill valve when the fluid level is below a first selected level and closing the tank fill valve when the fluid level is above a second selected level;

flush means for selectively discharging the fluid within the tank, the flush means including a selectably operable flush lever that initiates the fluid discharge; and catch means for preventing said float means from opening the tank fill valve unless said flush lever is activated.

3. A device as recited in claim 2 wherein said catch means includes a catch arm coupled to the flush lever and adapted to engage the float means to prevent the float means from opening the tank fill valve unless the flush lever is activated.

4. A device as recited in claim 3 further comprising a clamp arrangement for attaching said catch arm to said post and a chain for coupling said catch arm to said flush lever.

5. A device as recited in claim 4 wherein said float means includes a float slideably coupled to the post, the float being buoyant and adapted for riding up and down with the fluid level for detecting said first and second fluid levels, the catch arm being balanced and sized such that it rests underneath the float to prevent the float from traveling downward along the post after the tank has been filled and wherein said chain is adapted to trip the catch arm when said flush lever is activated, whereby, when the catch arm is tripped, the float is free to slide vertically along the post to detect said first selected fluid level to cause the tank fill valve to open and when the catch arm is not tripped, the float is prevented from sliding vertically along the post and is prevented from detecting said first selected fluid level.

6. A device as recited in claim 5 wherein said catch arm includes a counterweight arm portion and a float engaging portion, wherein the float engaging portion is adapted to prevent the float from descending to detect the first selected fluid level unless the flush lever has been actuated, and the counterweight arm portion for causing the float engaging portion to seat underneath the float when the tank is filled to the second selected level.

7. A device as recited in claim 3 wherein said float means include a float lever arm, a float disposed on one end of the float arm, the float being buoyant and adapted for riding up and down with the fluid level for detecting said first and second fluid levels, and wherein the catch arm is balanced and sized to engage the float arm after the tank has been filled to prevent the float from traveling downward, whereby, when said catch arm is tripped, said float is free to travel vertically to detect said first fluid level and when the catch arm is not tripped, the float is prevented from detecting said first selected fluid level.

8. A device as recited in claim 7 further comprising a mounting plate mounted to the post for carrying the catch arm.

9. A device as recited in claim 8 wherein said catch arm is sized and shaped to rest on the flush lever.

10. A device as recited in claim 9 wherein the catch arm includes a counterweight portion for engaging the flush lever and a float engaging portion adapted to prevent the float from descending to detect the first selected fluid level unless the flush lever has been actuated, the counterweight portion for causing the float engaging portion to engage the float arm when the bowl is filled to the second selected level.

* * * * *